United States Patent [19]

Stevenson

[11] Patent Number: 4,801,150

[45] Date of Patent: Jan. 31, 1989

[54] TRAPSHOOTING TARGET

[76] Inventor: Paul W. Stevenson, 102 E. Elmview Pl., Alamo Heights, Tex. 78209

[21] Appl. No.: 67,206

[22] Filed: Jun. 29, 1987

[51] Int. Cl.[4] ..... F41J 9/16

[52] U.S. Cl. ..... 273/362

[58] Field of Search ..... 273/362, 363, 364, 365, 273/424

[56] References Cited

U.S. PATENT DOCUMENTS 1,539,977 6/1925 Verschoyle ..... 273/362

3,855,728 12/1974 Hynds ..... 273/424 X 4,307,535 12/1981 Martin ..... 273/424 X

FOREIGN PATENT DOCUMENTS 2100107 7/1972 Fed. Rep. of Germany ..... 273/365

*Primary Examiner*—Carlton R. Croyle

*Assistant Examiner*—Leonard P. Walnoha

*Attorney, Agent, or Firm*—John R. Merkling

[57] ABSTRACT

A trapshooting target comprising at least two parts. A first part comprises a regular polygon or disc and carries at least one detachable second part. Separation of the parts during flight causes a change in the flight path of the parts.

10 Claims, 2 Drawing Sheets

TRAPSHOOTING TARGET

FIELD OF INVENTION

This invention relates generally to trapshooting targets and more particularly to a novel target having two or more parts capable of separating in flight.

PRIOR ART

In the past, trapshooting targets, suitable for launching from a catapult or similar device, have comprised a generally circular, one-part, brittle inverted bowl. A catapult throws a prior art trapshooting target into the air, imparting to the target both a linear and a rotational motion. The rotational motion contributes to the stability of the target in flight. In general, such a target will follow a relatively uniform trajectory after it is discharged from the catapult. Such a target, therefore, does not imitate the ability of birds to change direction in flight.

BRIEF SUMMARY AND OBJECT OF THE INVENTION

The present invention provides for a trapshooting target comprising at least two shells. A first shell comprises a regular polygon or disc having at least one indentation for receiving at least one second, or carried shell. When simultaneously ejected from a catapult, the two shells initially act as a single unit, but they soon separate in flight, with an apparent change in trajectory. In addition, one or more of the parts may begin to tumble, which further alters the speed and direction of flight of the tumbling part.

With the foregoing in mind, it is an object of the present invention to provide a novel trapshooting target comprising at least two shells.

A further important object of the present invention is to provide a trapshooting target which will change speed and direction of travel after being ejected from a catapult, thereby more closely simulating the flight of a game bird.

It is an additional object of the present invention to provide a trapshooting target which can provide multiple targets during a single operation of a catapult.

It is an additional dominant object of the present invention to provide a novel trapshooting target which will begin to tumble during flight, thus changing the velocity and direction of flight and simulating the flight characteristics of a game bird.

These and other objects of the present invention will be apparent from the detailed description, taken with reference to the accompanying drawings.

DETAILED DESCRIPTION OF ILLUSTRATED EMBODIMENT

Reference is now made to the drawings wherein like numerals are used to designate like parts throughout.

Referring now to FIGS. 1, 3, 5, and 7, a multi-part trapshooting target, generally designated 10 is shown. The target 10 comprises a lower primary shell 12 and a relatively smaller secondary shell 14. In the embodiment illustrated in FIG. 1, the secondary shell 14 is generally circular in shape, however, as more fully explained below, the secondary shell 14 may have other shapes without departing from the spirit of the present invention.

Figure 1:
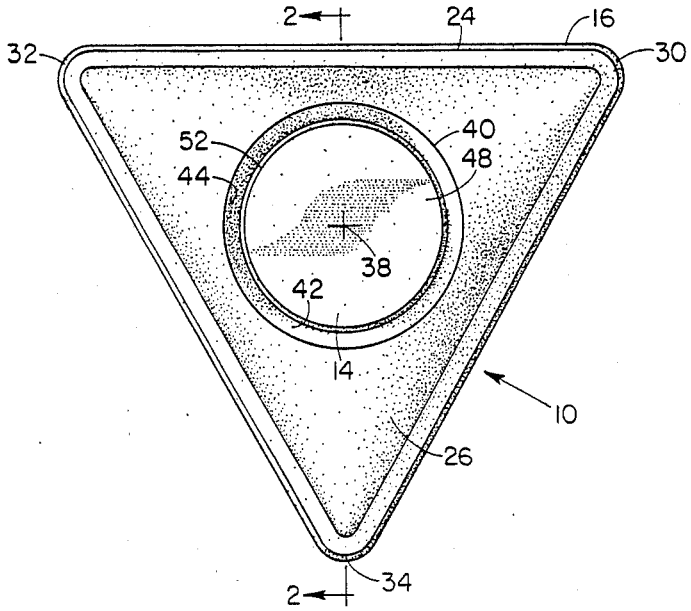
FIG. 1 is a view of a two-part triangular target made in accordance with the principles of this invention.
Figure 5:
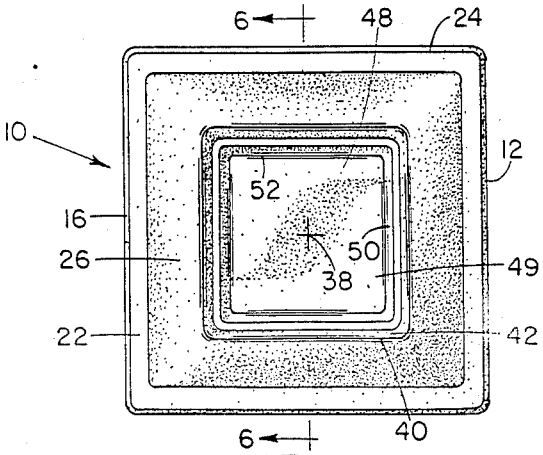
FIG. 5 is a view of a two-part square target made in accordance with the principles of this invention.

The primary shell 12 comprises an outside edge 16. The edge 16 may define a circle, as illustrated in FIG. 3, or may generally define a regular polygon such as a triangle or square, as illustrated in FIGS. 1 and 5 respectively. The edge 16 is oriented with a slight tilt toward a geometric center 38 of the primary shell 12 from a base plane 18. The base plane 18 is defined by a lower edge 20 of the primary shell 12. The outside edge 16 joins a circumferential lip 20 at corner 24. A curved surface 26 connects to the lip 22 and raises above the plane of the lip 22. The curved surface 26 has a generally uniform curve on a cross section tangent to the outer edge 16 if the cross section is not taken at point where the outer edge 16 rapidly changes direction. For example, a uniform curve in cross section is shown at 28 in FIG. 2. Whenever there is an abrupt change in direction in the outer edge 16, as, for example, at corners 30, 32, and 34 of FIG. 1, the upper curved surface 26 forms a more gradual curve, such as curve 36 in FIG. 2, along a linear area from the point of abrupt change towards the geometric center 38 of the primary shell 12 as, for example, in FIG. 1 from corner 34 along line 1—1 towards the geometric center 38 of the primary shell 16.

The upper curved surface 26 is truncated at edge 40 and a depression 42 is symmetrically formed around the geometric center 38 of the primary shell 16 by an inward edge 44 and a generally planar surface 46. The primary shell 12 further comprises an inner surface 47 which is generally uniformly spaced away from the outer edge 16, the lip 22, the curved surface 26, the inward edge 44 and the planar surface 46.

The secondary shell 14 comprises a plate 48 and a lip 50 at an outer edge 52 of the plate 48. As shown in FIG. 1, the plate 48 may have a circular outline, or as shown in FIG. 5, it may have a square or rectangular shape. Clearly, other outlines for the plate 48 can be chosen without departing from the spirit of the present invention.

Figure 2:
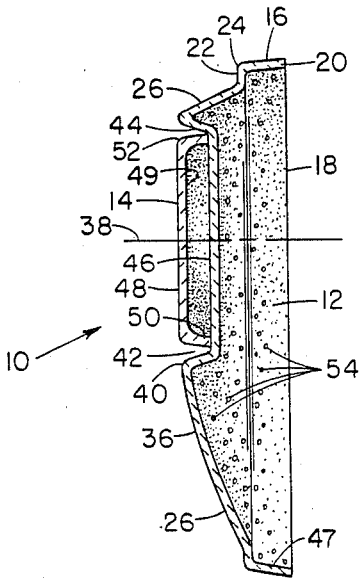
FIG. 2 is a cross-sectional view of the triangular target of FIG. 1 taken along line 2—2 of FIG. 1.
Figure 3:
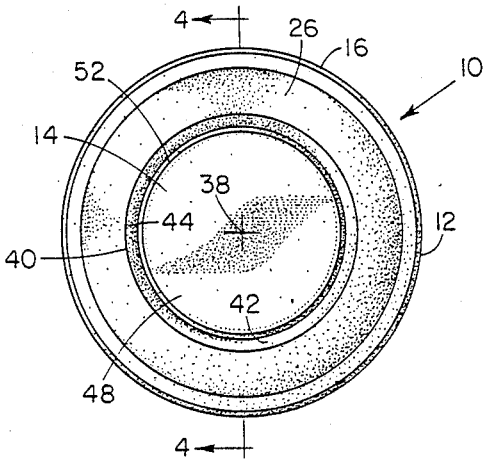
FIG. 3 is a view of a circular two-part target made in accordance with the principles of this invention.
Figure 4:
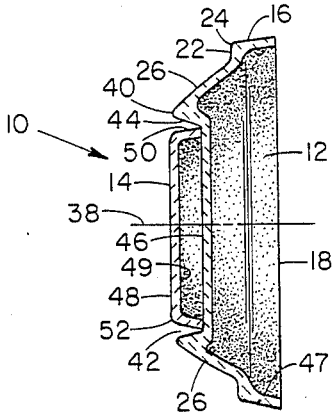
FIG. 4 is a cross-sectional view of the circular target of FIG. 3 taken along line 4—4 of FIG. 3.
Figure 6:
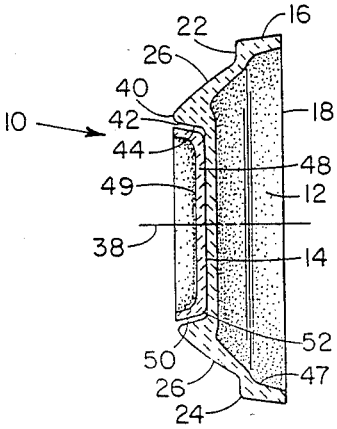
FIG. 6 is a cross-sectional view of the square target of FIG. 5 taken along line 6—6 of FIG. 5.

The secondary shell 14 may be placed in the depression 42 in the primary shell 12 with the lip 50 resting against the bottom surface 46, as shown in FIG. 2, or the secondary shell 14 may be placed in the depression 42 with the plate 48 resting against the bottom surface 46 of the depression 42 as shown in FIG. 6.

In the preferred embodiment, the shells 12, 14 comprise clay formed by pouring clay slip into a mold, in a conventional manner. When the clay has solidified, the shell can be removed from its mold and fired in a kiln. After the primary shell 12 or the secondary shell 14 cool, the inner surface 47 or an interior surface 49, respectively, can be coated with an adhesive and wild flower or grass seeds 54 can be affixed to the inner surface 47. The seeds 54 do not impede the flight of the target 10, but contribute to rehabilitation of a shooting area.

When a catapult fires the target 10, the target 10 initially leaves the catapult with both the primary shell 12 and the secondary shell 14 traveling as a single unit. Initially the target 10 moves at a relatively high velocity along a relatively uniform trajectory. In addition to forward motion, a catapult usually imparts a rotational motion to the target 10. After a brief flight, the two shells 12, 14 of the target 10 disengage. Considering the primary shell 12 and the secondary shell 14 as a system, the center of gravity of the target 10 continues to move along substantially the initial trajectory, but the primary shell 12 and the secondary shell 14 depart from the initial trajectory on different angles. In general, the primary shell is deflected from the initial trajectory less than the secondary shell 14 because the primary shell 12 is larger and more massive than the secondary shell 14.

As the primary shell 12 and the secondary shell 14 disengage, they generally begin to tumble. The degree to which tumbling takes place is primarily a function of the shape of the shell. Tumbling increases the air resistance of the shell and will, consequently, alter the speed and trajectory of the shell. Because tumbling does not commence until substantially the same time that the primary shell 12 and the secondary shell 14 disengage, the target 10 exhibits an unpredictable change in trajectory and velocity after the target 10 has been fired by a catapult.

Figure 7:
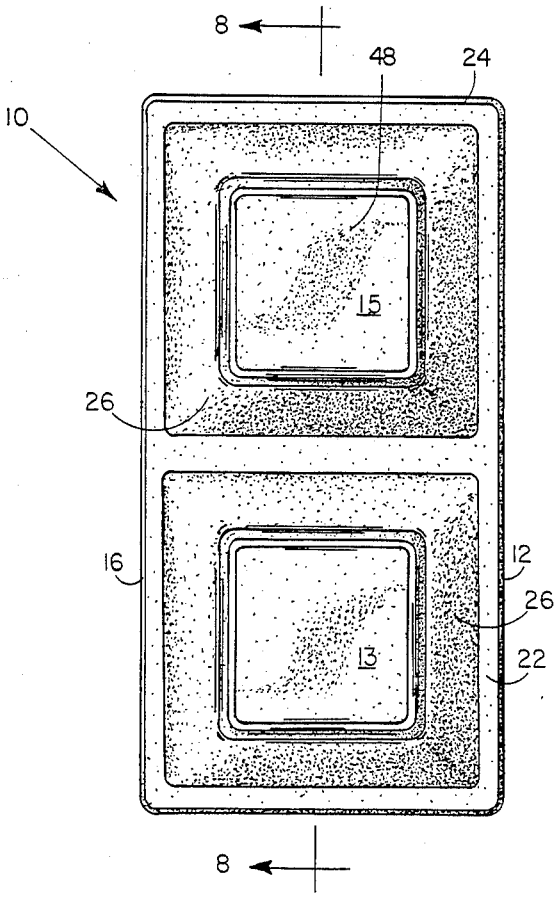
FIG. 7 is a view of a three-part rectangular target made in accordance with the prevent invention.
Figure 8:
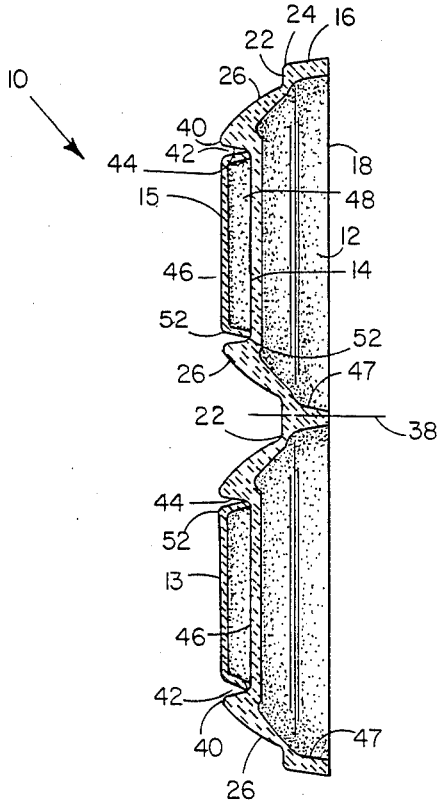
FIG. 8 is a cross-sectional view of the target of FIG. 7 taken a long line 8—8 of FIG. 7.

A further embodiment of the invention is illustrated in FIGS. 7 and 8. As shown in FIGS. 7 and 8, a target 10 may comprise a primary shell 12 and a plurality of secondary shells. For example, in FIGS. 7 and 8 a first secondary shell 13 and a second secondary shell 15 are spaced about the geometric center 38. Clearly, multiple secondary shells may be disposed in depressions 42, which depressions should be symmetrically located around the geometric center 38 of the primary shell 12.

The invention may be embodied in other specific forms without departing from the spirit or essential characteristics thereof. The present embodiments are therefore considered in all respects as illustrative and not restrictive, the scope of the invention being indicated by the appended claims rather than by the foregoing description, and all changes that comes within the meaning and range of equivalency of the claims are therefore intended to be embraced therein.

What is claimed and desired to be secured by United States Letters Patent is:

1. A trapshooting target adapted to be thrown through air by a catapult or similar device capable of imparting both a linear and a rotational motion to the target, said target comprising a primary shell, said primary shell comprising a convex upper surface, said upper surface having at least one edge bounded by at least one side wall;

said upper surface further having at least one depression for detachably receiving at least one secondary shell carried on said primary shell, said depression having an inward edge and a planar bottom surface, said inward edge defining the depth of the depression;

said secondary shell being substantially smaller and less massive than said primary shell and comprising a plate having at least one secondary shell edge bounded by at least one secondary shell side wall, said secondary shell side wall having substantially the same depth as the inward edge of the depression, whereby passage of the target through the air creates lift to raise the secondary shell out of the depression and causes the primary and secondary shells to begin to tumble as the secondary shell emerges from the depression.

2. A target according to claim 1 wherein said at least one edge comprises at least three edges and wherein said at least one side wall comprises at least three side walls.

3. A target according to claim 8 wherein said at least three edges form a regular polygon.

4. A target according to claims 1, 2, or 3 wherein said shell receiving means is effective to receive said secondary shell substantially symmetrically around a geometric center of said upper surface of said primary shell.

5. A target according to claims 1, 2, or 3 wherein said at least one shell receiving means comprises at least two shell receiving means and wherein said at least one secondary shell comprises at least two secondary shells.

6. A target according to claim 5 wherein said at least two shell receiving means are effective to receive said at least two secondary shells spaced substantially symmetrically away from a geometric center of said upper surface of said primary shell.

7. A target for trapshooting comprising a primary shell, said primary shell comprising an upper surface, said upper surface having at least one edge bounded by at least one side wall;

said upper surface further having at least two means for detachably receiving at least two secondary shells carried on said primary shell;

each said secondary shell comprising a plate having at least one secondary shell edge bounded by at least one secondary shell side wall.

8. A target according to claim 7 wherein said at least one edge comprises at least three edges and wherein said at least one side wall comprises at least three side walls.

9. A target according to claim 8 wherein said at least three edges form a regular polygon.

10. A target according to claims 7, 8 or 9 wherein said at least two shell receiving means are effective to receive said at least two secondary shells spaced substantially symmetrically away from a geometric center of said upper surface of said primary shell.

* * * * *